United States Patent [19]

Bohlander

[11] Patent Number: 4,587,414

[45] Date of Patent: May 6, 1986

[54] APPARATUS FOR ADJUSTING THE POSITION OF AN EDGE WITH SURFACE PORTIONS REFLECTING DIFFERENT WAVELENGTHS OF LIGHT

[75] Inventor: Peter Bohlander, Dusseldorf, Fed. Rep. of Germany

[73] Assignee: Betriebsforschungsinstitut VDEh Institut fur angewandte Forschung GmbH, Dusseldorf, Fed. Rep. of Germany

[21] Appl. No.: 502,706

[22] Filed: Jun. 9, 1983

[30] Foreign Application Priority Data

Jun. 16, 1982 [DE] Fed. Rep. of Germany ..... 3222629

[51] Int. Cl.[4] ..... G05B 1/00

[52] U.S. Cl. ..... 250/202; 250/548; 250/226

[58] Field of Search ..... 250/202, 548, 226, 557, 250/561; 318/577; 356/376, 377; 226/45

[56] References Cited

U.S. PATENT DOCUMENTS 4,146,797 3/1979 Nakagawa ..... 250/548

*Primary Examiner*—David C. Nelms
*Assistant Examiner*—James Gatto
*Attorney, Agent, or Firm*—Holman & Stern

[57] ABSTRACT

Apparatus for adjusting the position of an edge between two surface portions of a moving belt with different spectral reflectivities where required in connection with work or treatment needed along the edge of one of the two surface portions while the belt is moving. It is a pre-requisite condition that the mutually adjacent surfaces of the belt are sufficiently significantly optically detectable which is impaired, for example, in the presence of surface contamination by dirt and the like. In order to obtain a significant signal in such circumstances, the edge region is illuminated and an imaging or focussing lens associated with a beam splitter is arranged in the focus beam. Following the beam splitter the two part-beams pass through one filter each to impinge on in each case a photodiode receiver, each filter blocking passage in that wavelength range in which the other filter is transmissive. The diode potentials which are produced by the two part-beams then are applied in the form of a quotient to control or steer a device which effects transverse displacement of the belt. A sufficiently significant control signal is obtained even if the reflectivity of the surfaces is reduced by scratches, fingerprints or other dirt contamination.

6 Claims, 3 Drawing Figures

APPARATUS FOR ADJUSTING THE POSITION OF AN EDGE WITH SURFACE PORTIONS REFLECTING DIFFERENT WAVELENGTHS OF LIGHT

BACKGROUND OF THE INVENTION

1. Field of the Invention

The invention relates to apparatus for adjusting the position of an edge between two surface portions having relatively different reflection-coefficient to wavelength relations, both said surface portions extending in a plane of a longitudinally movable belt which is also movable in the plane of its surface in a direction transverse to its longitudinal movement.

2. Description of the Prior Art

A position adjustment of this kind may be useful for widely different technical purposes. For example, frequently it is necessary to apply some treatment along the edge of one of the two surface portions while the belt runs through. In many cases it is also necessary to apply treatment along a pre-drawn line which in its turn mostly has a certain minimum width to be sufficiently clearly perceptible so that in a manner of speaking it represents a surface defined by two edges and having a reflection coefficient which differs from that of the remaining surface. There must be different spectral reflectivities in order that optical detection can be effected. In other words this optical detectability of the difference in the two surfaces represents the basic criterion for the kind of device to which this invention relates.

Control system of the above discussed kind are however no longer feasible where the mutually adjacent surfaces of the belt or strip no longer have a significant size, i.e. where said pre-drawn line has a width of negligible size.

BRIEF SUMMARY OF THE INVENTION

It is the object of the present invention to provide apparatus which achieves a substantial improvement in the detectability of perceptability of optical differences between the adjacent surface portions. By this means the invention affords in positional edge control operations a greater measure of independence in respect of surface variations caused by dirt and like contamination.

This object is achieved by providing, in accordance with the invention, apparatus for adjusting the position of an edge between two surface portions having different spectral reflectivities, both of said surface portions extending in the plane of a longitudinally movable belt which is also transversely movable in the plane of its surface relative to the direction of its longitudinal movement, said apparatus comprising an illuminating lamp which can be directed at those parts of said surface portions adjacent to the edge between them, a focussing optic for receiving light reflected from said illuminated parts of both of said surface portions, a beam splitter for splitting the beam passing through said focussing optic, a pair of filters through which the pair of beams formed by said beam splitter respectively pass, a photodiode receiver associated with each filter and on which an image of said edge between said two surface portions will, in operation of the apparatus, fall, and a device for effecting said transverse movement of the belt, each of said filters being arranged to block light transmission in a range of wavelengths in which the other filter is transmissive, means for forming the quotient of the voltages generated in use by the beams falling on said photodiodes and means using said quotient voltage for controlling said device for effecting transverse movement of the belt in order to move the latter by a required distance in the required direction when the reflected light is not of precisely predetermined relative intensities in the two wavelength ranges which are allowed to pass through the filters. Thus, with the new apparatus, illumination is applied to a region of the belt plane which belongs partly to one and partly to the other of the two surface portions. With such an arrangement the optical image projection of one portion of this region also results in a charge in the focal plane in which the photodiode receivers are arranged which charge is a mixture of partial charges from two relatively differently reflecting surfaces and is significant for these. Since the quotient of the two photodiode potentials is used for positional edge control, there is also achieved a large measure of insensitivity regarding scratches, fingerprints or similar contaminations of the adjoining surfaces. The reflected mixed light must therefor when the optical axis of the focussing optic coincides with the edge of the mutually adjacent surfaces, show precisely predetermined relative intensities in the two wavelength ranges which are allowed to pass through the filters. Reflection-reducing contaminations as a rule equally affect both surfaces in view of the very small spatial extension of the measuring plane. The ascertained quotient is therefore a suitable means for controlling the device which is provided for effecting transverse displacement of the belt.

As far as the radiation is concerned which issues from the sighted target area of the belt, this may be produced in any convenient manner, either by stimulation, excitation or reflection. In the last mentioned case a lamp will be used which emits radiation in at least those wavelength ranges which are allowed to pass through the two filters.

Conveniently this illuminating lamp as well as the focussing optics will be arranged in a common housing, the two parts having mutually inclined optical axes for which the line bisecting the angle between said optical axes can be lined up perpendicularly on the plane defined by the surface portions. This, on the one hand, creates a fixed relation between the illuminating lamp and the focussing optic (lens) so that the lamp can also be focussed with a suitable lens. On the other hand this alignment facility generally affords a particularly high proportion of reflected radiation.

In an attractive embodiment of the invention each of the photodiode receivers comprise a central receiving element and a pair of side receiving elements arranged respectively on opposite sides of the central receiving element, the arrangement being such that in each case an image of the one surface portion is exclusively focussed on one side receiver of each photodiode receiver and the image of the other surface portion is exclusively focussed on the other side receiver of the same photodiode receiver when the edge in question is focussed on the central element of the photo-receiver. If then the position of the edge changes so as to move out of the central position of the central element of the photodiode receiver, a significant diode voltage will be produced which may then be used for moving the belt transversely in the direction of one or the other side.

In accordance with the principle of the invention divisional circuits are provided not only for the central elements of the photodiode receivers but also for the side receiver elements, the arrangement being such that in each case diode voltages arrive in a division circuit which come from photodiode receivers arranged on like sides of the central photodiode receiver. In other words with this division the basic focussings are mutually complementary in such a way that the voltage of one side photodiode receiver element onto which the one surface portion is focussed is divided by the voltage of a side photodiode receiver element belonging to the same part-beam system on which the same surface is focussed.

Particularly well suited for the control operation is an operation amplifier which is operated with or by the quotient signals produced as hereinbefore described. This amplifier is fed with the quotient signal of the two central photodiode receiver elements with double negative density weighting whilst the two further quotient signals arising from the division circuits receiving signals from the side receiver elements are respectively fed into the amplifier at simple positive weighting. The control loop is arranged such that the device for transverse belt displacement remains unaffected at zero output of the amplifier whereas at positive or negative output it displaces the belt within its plane in one or the other direction. In other words, in the operation amplifier the mean value of the quotients of the voltages from the two side photodiode receiver element pairs is compared with the quotient of the voltages from the central pair of elements of the photodiode receivers.

BRIEF DESCRIPTION OF THE DRAWINGS

The invention will now be described in detail with reference to the accompanying drawings showing an example of an embodiment and wherein.

DETAILED DESCRIPTION

Figure 1:
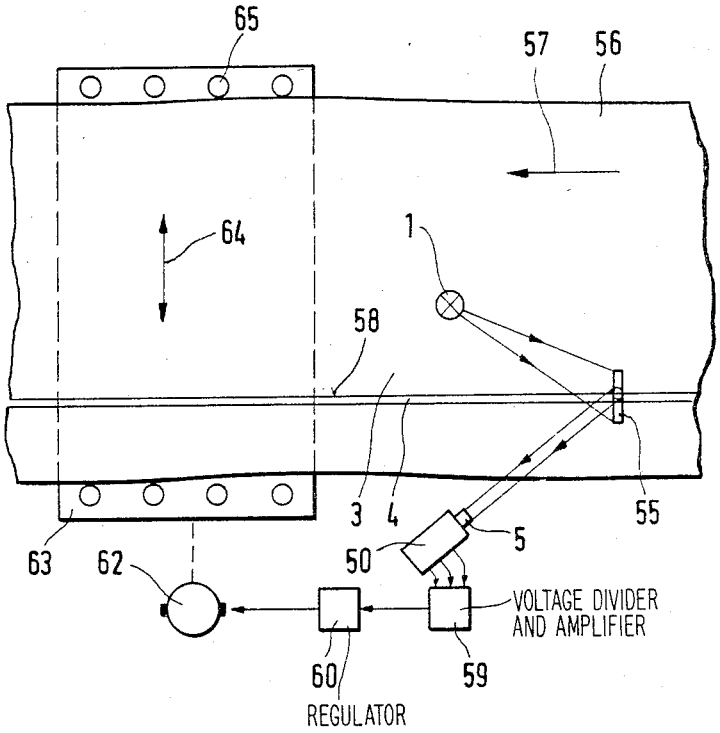
FIG. 1 is a schematic overall top plan view of one example of apparatus according to the invention.

Referring to FIG. 1 there is shown a belt 56 which travels in the direction of arrow 57 and which is subject to positional steering or control in respect of an edge 58 which relatively separates surface portions 4 and 3. The region 55 which is illuminated by a lamp 1 extends on either side of edge 58. A focussing optic 5 is set to the designed position of edge 58, the focussing zone being within the illuminated region of both surface portions.

Diode voltages are carried out of a housing 50 which serves to house a component 59 which will be more particularly described below and the output of which is applied to a regulator 60. A servo motor 62 connected to a guide table 63 enables the latter to be slidingly displaced in the direction of double-headed arrow 64 transversely of the direction of longitudinal travel of belt 56. On each side of belt 56 some guide rollers 65 engage with the belt so that displacement of the guide table results in a transverse displacement of the belt.

Figure 2:
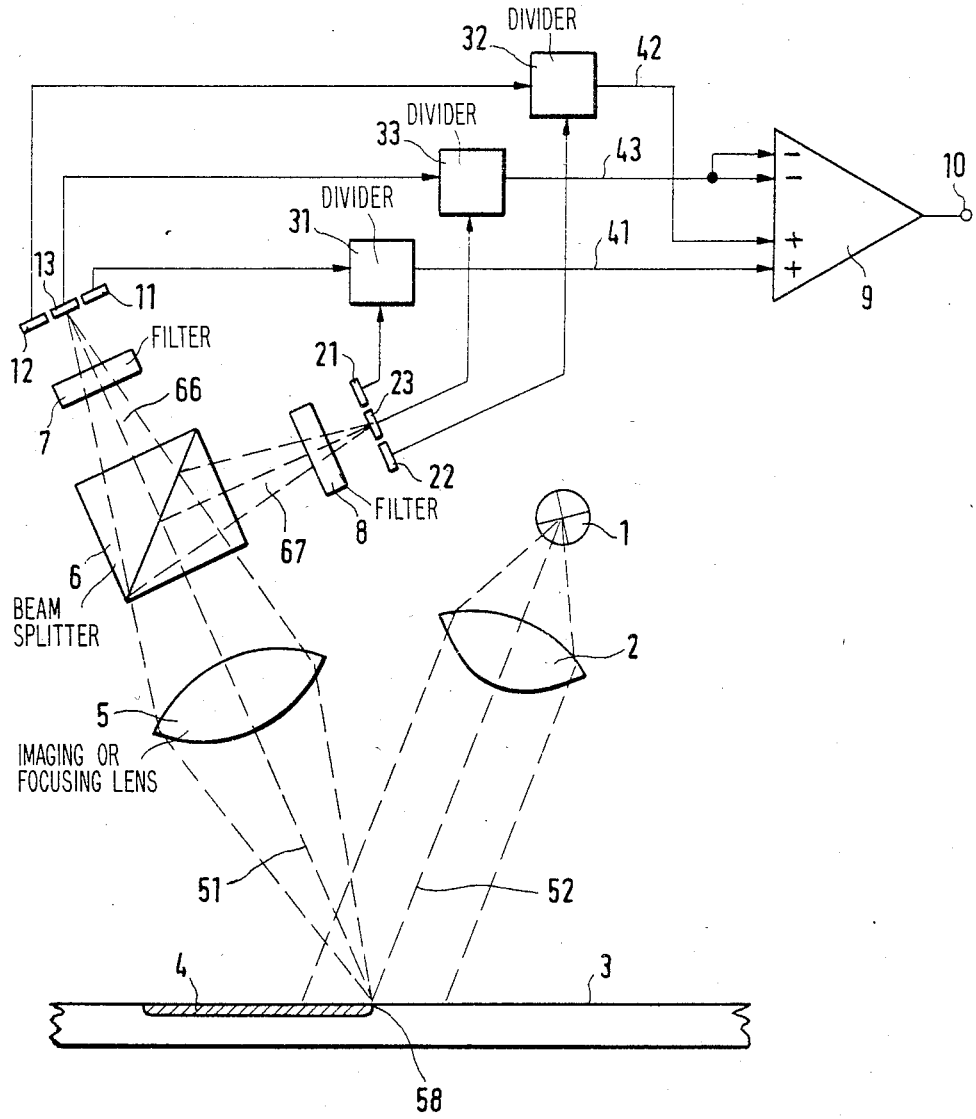
FIG. 2 is a schematic representation of the optical or electronic part of the apparatus.

FIG. 2 shows an enlarged portion of the belt as viewed in a perpendicular direction relative to the direction of viewing in FIG. 1, so that the surface portions 4 and 3 and the dividing edge therebetween, 58, are more clearly visible. The light rays which issue from lamp 1 are straightened into a parallel beam by a lens 2, their optical axis 52 impinging at an angle on the plane of surface portions 3 and 4. An imaging or focussing lens 5 is set under a corresponding opposite angle with its optical axis 51 to focus on edge 58. A beam splitter 6 behind the focussing lens 5 splits the received beams into two part-beams 66, 67 each of which passes through an optical filter 7 or 8, each filter having transmissivity in zones in which the other filter is not transmissive, to a photodiode receiver. Each of said photodiode receivers has three elements namely a central receiving element and a pair of side receiving elements disposed respectively on opposite sides of the central receiving element and when the optical axis 51 is lined up precisely with edge 58 focussing will occur in the central elements of photodiode receivers 13 or 23. If, due to a positional shift of the belt, or to a non-rectilinear edge 58, the side photodiode receiver elements 13, or 23 exclusively "see" one surface portion 4, or the other surface portion 3, the mixed image of both surface portions 3 and 4 is projected on side photodiode receiver element 21 or 11 or on side photo-receiving element 22 or 12, respectively.

The diode voltages of the central photodiode receiver elements 13, 23 are applied to a division circuit 33 where a quotient 43 is applied at double negative density weighting to an operation amplifier 9. Also applied to the latter are the quotients of the diode voltages of side photodiode receiver elements 11 and 21 on the one hand and side receiver elements 12 and 22 on the other hand, in each case with simple positive density weighting. The output potential of the circuit is zero when the image of edge 58 on surface portion 4 falls into the central photodiode receiver elements 13 and 23. If the image shifts so that these central receiver elements 13 and 23 for the major part see surface portion 4, the potential 10 becomes negative. On the other hand, if the share of surface portion 3 in the image increases the potential 10 becomes positive. Potential 10 is then applied as output of circuit 59 to the regulator 60 according to FIG. 1, so that the guide table 63 will be operated to compensate for potential positional deviations of edge 58.

Figure 3:
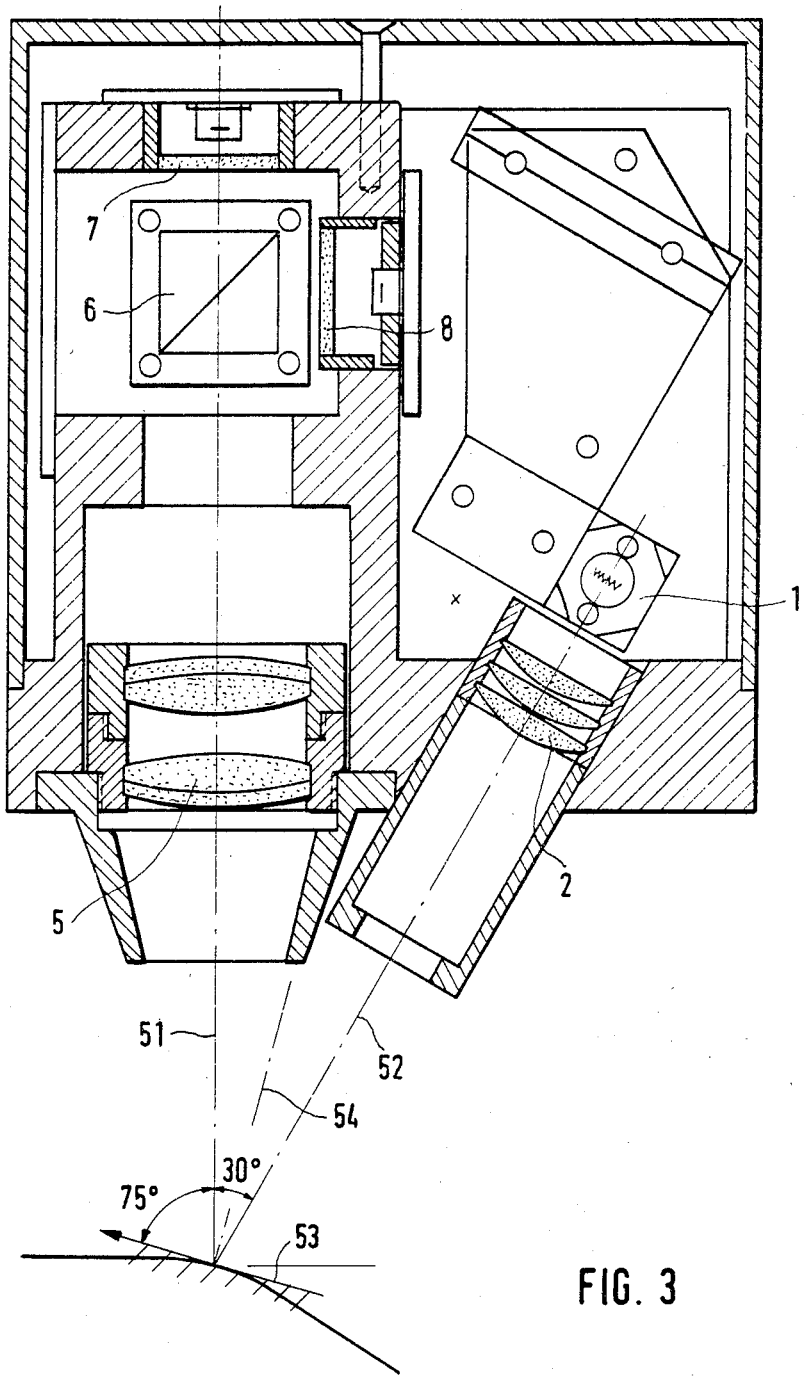
FIG. 3 is a cross sectional view showing the mechanical construction of the optical and electronic device.

FIG. 3 shows the mechanical construction. According to this the lamp 1 with its lens 2 as well as the focussing optics 5 are mounted fixedly in a common housing 50. The optical axes 51, 52 intersect each other in the belt plane and are normally set in such a way that the line 54 bisecting the angle between axes 51 and 52 is perpendicular to plane 53 of the belt. The impingement point is the edge 58. The housing 50 further accommodates the beam splitter 6, and also the filters 7 and 8 and the photodiode receivers behind these.

I claim:

1. Apparatus for adjusting the position of an edge between two surface portions having different spectral reflectivities, both of said surface portions extending in the plane of a longitudinally movable belt which is also transversely movable in the plane of its surface relative to the direction of its longitudinal movement, said apparatus comprising:

an illuminating lamp mounted to be directed at those parts of said surface portions adjacent to the edge between them;

a focussing optic for receiving light reflected from the parts of said surface portions illuminated by said illuminating lamp;

a beam splitter for splitting the beam passing through said focussing optic;

a pair of filters through which the pair of beams formed by said beam splitter respectively pass, each of said filters being arranged to block light transmission in a range of wavelengths in which the other filter is transmissive to produce two wavelength ranges;

a photodiode receiver associated with each filter and on which an image of said edge between said two surface portions will fall in operation of the apparatus;

a device for effecting transverse movement of the belt;

means for forming the quotient of the voltages generated in use by the beams falling on said photodiodes; and means using said quotient voltages for controlling said device to effect transverse movement of the belt in order to move the latter by a required distance in the required direction when the reflected light is not of precisely predetermined relative intensities in the two wavelength ranges which pass through said filters.

2. Apparatus as claimed in claim 1 wherein said illuminating lamp emits radiation in at least those wavelength ranges which pass through said pair of filters.

3. Apparatus as claimed in claim 1, wherein: said illuminating lamp and focussing optic are mounted in a common housing with their optical axes mutually inclined, so that a line bisecting the angle between said optical axes extends perpendicularly to the plane defined by said two surface portions.

4. Apparatus as claimed in claim 1 wherein each photodiode receiver comprises: a central receiver element and a pair of receiver elements arranged respectively on the opposite sides of said central element, so that one of said side receiver elements of each photodiode receiver receives an image of one of said two surface portions of the belt and the other side receiver element of each photodiode receiver receives an image of the other surface portion of the belt when the edge between said surface portion is focussed on the central receiver element of each photodiode receiver.

5. Apparatus as claimed in claim 4 wherein: said voltage quotient forming means comprise division circuits; each side receiver element of one photodiode receiver is connected with a complementary side receiver element of the other photodiode receiver to an associated side division circuit; and amplifier means operatively connected to said division circuits which in turn is connected to said device for effecting transverse movement of the belt.

6. Apparatus as claimed in claim 5 wherein: said central receiver elements of said two photodiode receivers are connected to a central division circuit which is also connected to said amplifier means, said division circuits and amplifier means being mutually associated so that signals transmitted from said central division circuit are applied with double negative weighting to said amplifier means and signals transmitted from said side division circuits are each applied to said amplifier means with simple positive weighting, all of said signals applied to said amplifier means being added together in such a way that said device for effecting transverse movement of the belt will remain unaffected at zero output signals from said amplifier means and will displace the belt to one side or the other in response to a positive or negative output potential.

* * * * *